United States Patent [19]

Richey

[11] Patent Number: 4,542,819

[45] Date of Patent: Sep. 24, 1985

[54] JOINTED CONVEYOR

[75] Inventor: Earl D. Richey, Irvine, Calif.

[73] Assignee: The United States of America as represented by the Secretary of the Army, Washington, D.C.

[21] Appl. No.: 659,142

[22] Filed: Oct. 9, 1984

Related U.S. Application Data

[63] Continuation of Ser. No. 444,137, Nov. 24, 1982, abandoned.

[51] Int. Cl.[4] ..... F41D 10/00

[52] U.S. Cl. ..... 198/584; 89/33.2

[58] Field of Search ..... 198/584; 89/33.1, 33.2, 89/33.02, 33.5, 33.17, 33.14, 33.16, 34, 33.01, 45, 35.01, 46, 33.25

[56] References Cited

U.S. PATENT DOCUMENTS 783,771 2/1905 Anderson ..... 198/584

4,244,270 1/1981 Tassie ..... 89/33 C

*Primary Examiner*—Stephen C. Bentley

*Assistant Examiner*—John S. Maples

*Attorney, Agent, or Firm*—Anthony T. Lane; Robert P. Gibson; Michael C. Sachs

[57] ABSTRACT

A jointed conveyor for ammunition has an upstream and downstream conveying device. Each of these devices has an upstream and downstream end. The conveying devices can operate to convey the ammunition from the downstream end of the upstream conveying device to the adjacent upstream end of the downstream conveying device. Both of the conveying devices are mounted to articulate, one with respect to the other, about their adjacent ends. Also included is an upstream and downstream curved guide mounted on the upstream and downstream conveying devices, respectively. The guides are positioned to move alongside each other as the conveying devices articulate into a predetermined position. The conveyor also has a linkage slidingly coupled to both of the guides.

3 Claims, 3 Drawing Figures

FIG. 1
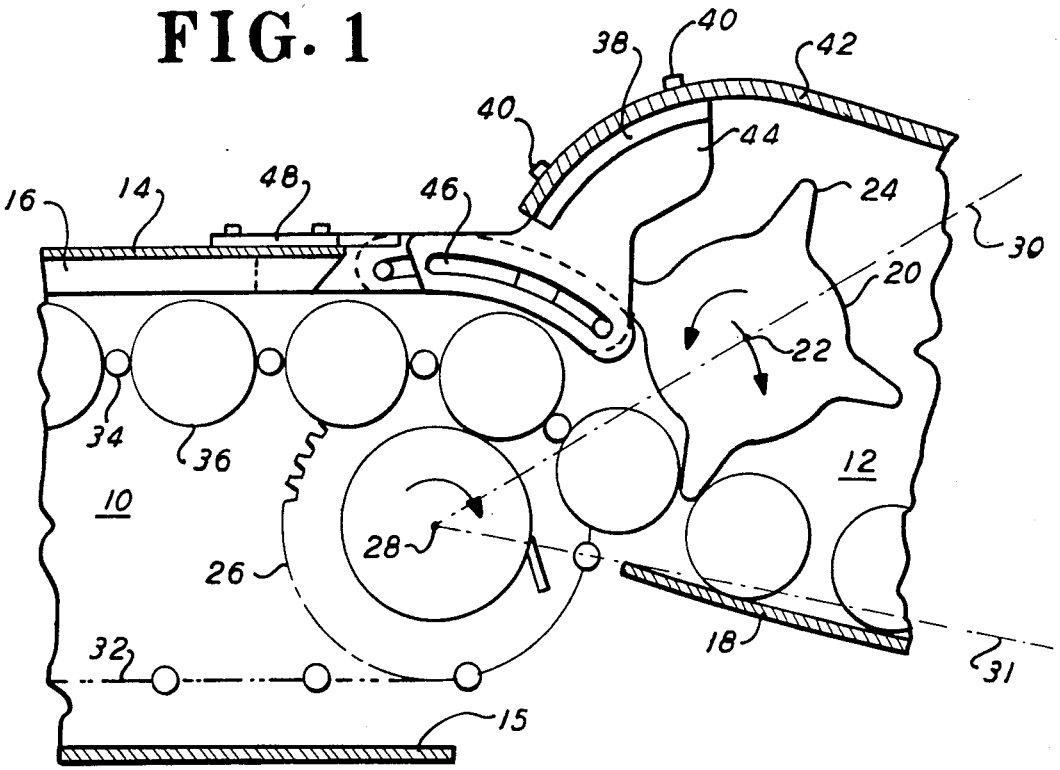
FIG. 2
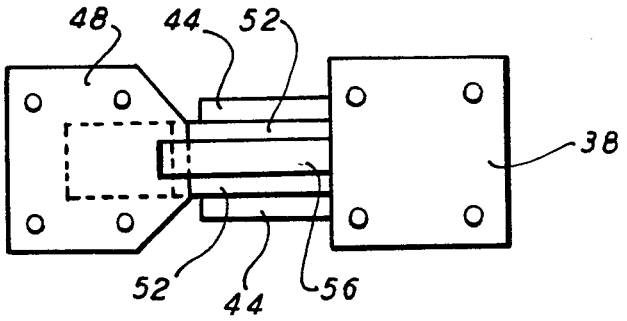
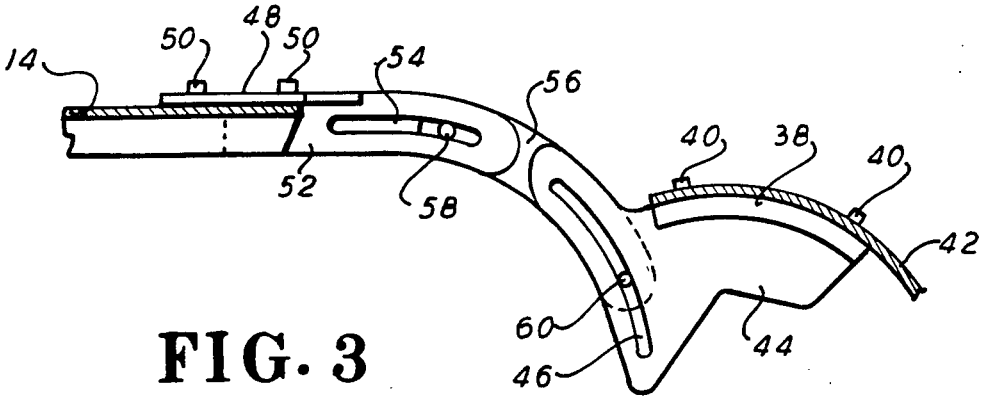
FIG. 3

JOINTED CONVEYOR

GOVERNMENT INTEREST

The invention described herein was made in the course of a contract with the Government, Number DAAK10-78-C-0057 awarded by the Department of the Army, and may be manufactured, used and licensed by or for the Government for governmental purposes without the payment to us of any royalty thereon.

This application is a continuation of application Ser. No. 444,137 filed Nov. 24, 1982.

BACKGROUND OF THE INVENTION

The present invention relates to conveyors for moving ammunition, and in particular, to devices having guides that prevent jamming at conveyor joints.

It is useful to have an adjustable conveyor for feeding ammunition from a magazine to an elevationally movable gun. Unless the conveyor between the magazine and gun can accommodate relative motion it is necessary to mount the magazine on the gun to rotate with it elevationally. Such mounting increases the weight on the trunnion making rotation more difficult.

Certain problems exist in transferring ammunition along an adjustable conveyor to an elevationally rotatable gun. The conveyor from the magazine to the gun must retract and extend to account for the varying spacing between them as the gun rotates elevationally. In the event that an articulated conveyor is used, the problem exists of providing guides at the conveyor joints which avoid jamming as the conveyor articulates. In particular, a gap may widen as the conveyor articulates and result in the jamming of ammunition in the gap.

Accordingly, there is a need for an articulated conveyor having guides that can reliably guide ammunition through a conveyor joint and avoid jamming.

SUMMARY OF THE INVENTION

In accordance with the illustrative embodiment demonstrating features and advantages of the present invention, there is provided a jointed conveyor for ammunition. The conveyor has an upstream and downstream conveying means, each having an upstream and downstream end. The conveying means are operable to convey the ammunition from the downstream end of the upstream conveying means to the adjacent upstream end of the downstream conveying means. Both of the conveying means are mounted to articulate one with respect to the other about their adjacent ends. The conveyor also has an upstream and downstream curved guide mounted on the upstream and downstream conveying means, respectively. These guides are positioned to move alongside each other as the conveying means articulate into a predetermined position. The conveyor also has a linkage slidably coupled to both of the guides.

By employing such apparatus, a highly efficient and reliable conveyor is provided. In particular, the guides and linkage can telescope so that a troublesome gap does not effectively exist as the two conveying means articulate.

In a preferred embodiment the guides take the form of two pairs of parallel tangs, each pair mounted to a separate, respective conveyor chute. Both pairs of tangs preferably embrace a sliding member which has outwardly projecting pins at either end. These pins engage corresponding slots in each of the tangs. The tangs and the sliding member each have a common radius of curvature centered at the axis of rotation of the joint between the two chutes. In an especially preferred embodiment, one pair of tangs is sized to straddle both of the tangs of the other pair. With this embodiment, maximum articulation in one direction causes the tangs to separate but remain connected by means of the sliding member.

In this preferred embodiment each of the chutes can employ a pair of circulating endless chains spanned by a plurality of evenly spaced pusher rods. The rounds of ammunition fit in between the pusher rods. The downstream chute can have a hand-off sprocket which orbits about the joint axis. The hand-off sprocket has projecting spokes which engage incoming rounds of ammunition and push them into the downstream conveyor chute.

BRIEF DESCRIPTION OF THE DRAWINGS

The above brief description as well as other objects, features and advantages of the present invention will be more fully appreciated by reference to the following detailed description of a presently preferred but nonetheless illustrative embodiment in accordance with the present invention when taken in conjunction with the accompanying drawings wherein:

FIG. 1 is a side elevational view, partly in section, of a jointed conveyor according to the principles of the present invention;

FIG. 2 is a top view of a portion of the conveyor of FIG. 1;

FIG. 3 is a side elevational view of a portion of the conveyor of FIG. 1 showing the position of the guides when the conveyor chutes are articulated to a predetermined location.

DETAILED DESCRIPTION OF THE PREFERRED EMBODIMENT

Referring to FIGS. 1 and 2, the jointed conveyor shown therein has upstream conveyor means 10 and downstream conveying means 12. Conveying means 10 and 12 are in the form of rectangular chutes having four walls and open opposite ends. Chute 10 has a wall 15 and guide wall 14 (other walls deleted) supporting inwardly projecting guide rib 16. Downstream chute 12 has a downstream guide wall 18 and upper wall 42, the two other walls again deleted for clarity.

Sprocket 20 centrally mounted in the upstream end of chute 12 rotates about sprocket axis 22. Sprocket 20 has, in this embodiment, four radial projections 24. Mounted in the downstream end of upstream chute 10 is gear 26 rotatably mounted about joint axis 28. Connecting brackets (schematically illustrated as common centerline 30) on the outside of chutes 10 and 12 connect axes 22 and 28 together so that sprocket 20 and chute 12 can orbit around joint axis 28. Gear 26 and sprocket 20 can be linked to be driven synchronously in the directions illustrated, by chains, gearing, synchronous motors or other similar apparatus not specifically illustrated herein.

Endless chains 32 circulate on gears such as gear 26. In this preferred embodiment, chains 32 comprise two parallel sets of chains on opposite sides of chute 10. Accordingly, gear 26 cooperates with another coaxial gear (not shown) on the opposite side of chute 10 at its downstream end. Spanning chains 32 are a plurality of evenly spaced pusher rods 34. The spacing between rods 34 is sufficient to fit therebetween rounds of generally cylindrical ammunition 36. Endless chains 32 follow an oval path and turn over another pair of gears (not shown) at the upstream end of chute 10 opposite the end carrying gear 26.

Referring to FIGS. 1, 2 and 3, a downstream curved guide is shown as a cylindrically shaped plate 38 attached by means of bolts 40 to the underside of wall 42 opposite wall 18. A pair of parallel tangs 44 are transversely mounted to project inwardly from plate 38. Tangs 44 flare into a curved portion having curved slots 46. Slots 46 and the inside edge of tangs 44 adjacent thereto having radii of curvatures centered at joint axis 28.

As best illustrated in FIG. 3, an upstream curved guide is shown herein as plate 48 bolted atop wall 14 by means of bolts 50. Mounted transversely to plate 48 are a pair of spaced parallel tangs 52 each having a curved slot 54 whose radius of curvature equals that of slot 46 and is also centered at joint axis 28 (FIG. 1). Again the inside edges of tangs 52 adjacent slots 54 have a radius of curvature centered at joint axis 28.

A linkage is shown herein as cylindrically shaped plate member 56 having outwardly projecting from the side of its upstream end an aligned pair 58 of transverse, opposing pins 58 (only one visible in FIG. 3), another pair of oppositely extending transverse pins 60 projecting from the side of the downstream end. Pins 58 and 60 are sized and positioned to slidingly fit within slots 54 and 46, respectively. The inside surface of member 56 has a radius of curvature matching that of tangs 52 and 44 and centered at joint axis 28 (FIG. 1).

To facilitate an understanding of the principles associated with the foregoing apparatus, its operation will be briefly described. It is initially assumed that the apparatus is positioned as shown in FIG. 1. Being linked and power driven, gear 26 and sprocket 20 rotate synchronously. Accordingly, gear 26 drives endless chains 32, causing them to circulate. Ammunition 36 is positioned in the spaces between rods 34 and is urged downstream by the latter. Upon reaching a position adjacent to sprocket 20, ammunition 36 is then urged by projections 24 to move from chute 10 to chute 12, being thus transferred from wall 14 to wall 18.

It will now be assumed that chute 12 is articulated so that sprocket 20 moves from line 30 to line 31 (FIG. 1), bringing the guides and linkage to the position shown in FIG. 3. In particular, the pair 52 and pair 44 of tangs separate. As they separate, pins 58 and 60 travel toward the extreme ends of slots 54 and 46. Member 56 can then arrive at the position shown in FIG. 3. It will be observed that member 56 spans the gap existing between tangs 44 and 52. Furthermore, tangs 52 and 44 as well as member 56 each remain with their identical inside radii of curvature centered at joint axis 28 (FIG. 1). Therefore, ammunition 36 is guided along a path that orbits joint axis 28, until reaching sprocket 20. Moreover, sprocket 20 maintains the same relative orientation to ammunition being carried around gear 26. This feature ensures that ammunition is guided to sprocket 20 properly and does not jam in the space that would ordinarily open should there be no guides between walls 42 and 14.

It is to be appreciated that various modifications may be implemented with respect to the above described preferred embodiment. For example, the guides and sliding linkage can take alternate forms. The sliding member can be an element slidingly fit into sleeve-like guides. Also, while two pairs of tangs are illustrated, in other embodiments more or fewer tangs may be employed. Additionally, while pins and slots are illustrated, in other embodiments dovetailed grooves, or other structure can be used instead. Furthermore, while a specific means for urging ammunition through the chutes is illustrated, in other embodiments gravity feed, an upstream line pusher or alternate pushers can be employed instead. Moreover, while a hand-off sprocket is illustrated, various other kinds of mechanical handing-off devices, including devices involving gravity effects, can be used. Moreover, the length and direction of the chain path and the chutes can be altered depending upon the size of ammunition and the number of rounds to be conveyed. Also, the drive for the illustrated sprockets, gears and chains can be applied independently or through various linkages. It is also expected that the illustrated chutes may have different shapes and different guides depending upon the type of ammunition being handled. Additionally, the various dimensions and materials described herein may be altered depending upon the desired ammunition caliber, length of travel, speed of operation, weight, space available, accuracy etc.

Obviously many modifications and variations of the present invention are possible in light of the above teachings. It is therefore to be understood that within the scope of the appended claims, the invention may be practiced otherwise than as specifically described.

I claim:

1. A conveyor mechanism for ammunition in a gun, the mechanism having an articulating joint therein where the ammunition is fed, comprising:

upstream and downstream respective chute means, said downstream chute means being operable to articulate, by means including exterior brackets, about a common joint axis with respect to said upstream chute means, wherein ammunition is conveyed from the upstream chute for feeding to the downstream chute across a gap at the junction of both the chute means, the respective chutes being separated by an amount of distance which varies by the relative degree to which the chutes articulate;

said upstream chute comprising an endless chain mounted within the upstream chute to circulate along the length thereof, the said chain comprising a plurality of parallel pusher rods transversely mounted on said chain at a spacing to allow the ammunition to fit therebetween; a powered gear element for driving said chain, positioned within said chute adjacent the end of the upstream chute at the joint area where articulation takes place, the ammunition passing over the gear element and dropping into the area of the joint, a guide wall above said chain and parallel thereto for holding down said ammunition as it is conveyed along the chain toward the joint area;

said downstream chute comprising a handoff sprocket mounted about a sprocket axis, a lower guide wall below the level of the sprocket axis and with one edge extending into said joint area to a point vertically below the transverse axis of a piece of ammunition as it comes off the chain in the joint area, said sprocket communicating with said ammunition and lower guide wall to pick off ammunition pieces as they orbit said joint axis through contact of the said guide wall edge and also by being pushed by said sprocket, down said guide wall into the downstream chute, said sprocket being powered in synchronism with said endless chain, there being a mechanism for insuring smooth ammunition transition across the joint area by preserving a constant gap thereacross of suitable precision despite articulation, said insuring mechanism comprising:

respective curved guide means mounted on the said upstream and downstream chute means, the respective guide means connected by a sliding linkage means; said linkage means comprising a link member having transverse pins projecting from said link member; a respective upstream and downstream pair of parallel tangs, said linkage positioned on a plane between both said pairs of tangs, one of said pair of tangs positioned to embrace the other pair, each of said tangs having a longitudinally disposed slot; said transverse pins being slidably mounted in said longitudinally disposed slots in said tangs.

2. A conveyor according to claim 1 wherein said member, and said upstream and downstream guide each has the samd radius of curvature, each centered at said joint axis.

3. A conveyor as in claim 2 wherein the upstream and downstream guides are of a dimension that when the chutes are articulated to a maximum degree the tangs lose contact with one another and a separation gap is created therebetween.

* * * * *